United States Patent [19]

Visan et al.

[11] 4,320,264

[45] Mar. 16, 1982

[54] LOUDSPEAKER WITH A HEAT RESISTANT TWO-PART DIAPHRAGM

[75] Inventors: Michel Visan; Lydia Isfan, both of Vincennes, France

[73] Assignee: Siare-Societe Industrielle d'Applications/Radio-Electriques, Saint-Maur-des-Fosses, France

[21] Appl. No.: 156,628

[22] Filed: Jun. 5, 1980

[30] Foreign Application Priority Data

Nov. 28, 1979 [FR] France ..... 79 29232

[51] Int. Cl.[3] ..... H04R 9/04; H04R 9/06

[52] U.S. Cl. ..... 179/115.5 R; 181/165

[58] Field of Search ..... 179/115.5 R, 115.5 VC, 179/181 R; 181/163, 164, 165

[56] References Cited

U.S. PATENT DOCUMENTS

| | | | |
|---|---|---|---|
| 1,916,223 | 7/1933 | Kalin | 181/165 |
| 1,969,256 | 8/1934 | Clark et al. | 179/115.5 VC |
| 2,004,735 | 6/1935 | Thomas | 179/115.5 VC |
| 3,906,171 | 9/1975 | Braceley | 179/115.5 VC |

FOREIGN PATENT DOCUMENTS

| | | | |
|---|---|---|---|
| 451178 | 7/1936 | United Kingdom | 179/115.5 R |

*Primary Examiner*—George G. Stellar

*Attorney, Agent, or Firm*—Diller, Ramik & Wight

[57] ABSTRACT

A loudspeaker is disclosed in which the frustoconical diaphragm is formed in two parts, including a first or outer part made of synthetic material e.g. polypropylene or polystyrene, and a second or inner part of paper or plastic material having higher heat resistance than the first part. The second part is therefore able to withstand the high temperatures of the moving coil support to which it is attached while affording advantages of synthetic material diaphragms.

15 Claims, 2 Drawing Figures

LOUDSPEAKER WITH A HEAT RESISTANT TWO-PART DIAPHRAGM

FIELD OF THE INVENTION

The present invention relates to loudspeakers, and more particularly to loudspeakers having a vibrating diaphragm actuated by means of a moving coil carried by a support.

BACKGROUND OF THE INVENTION

The advantages of loudspeakers provided with diaphragms of plastic material are already known and include their vibration response uniformity in the different zones of the diaphragm and their physical uniformity in comparison to paper diaphragms. This uniformity of the diaphragm produces a reduction in the number of resonant frequences which results in less "coloration" for the listener.

Nevertheless, plastic diaphragms which have low mechanical characteristics because of the low heat resistance of the plastic sheet material of which they are made (of the order of 100°–150° C. in general) limit the permissible power of the loudspeakers.

SUMMARY OF THE INVENTION

An object of the present invention is to overcome such drawbacks with plastic diaphragms.

According to the invention there is provided a loudspeaker of the type comprising a vibrating diaphragm actuated by a moving coil carried by a support. The loudspeaker is characterized in that the diaphragm comprises at least two parts made of different materials including a first or outer part of synthetic material and a second or inner part extending from the first part of synthetic material to the support for the moving coil, the second part being made of a material having greater heat resistance than that of the synthetic material of the first part.

Owing to the fact that the support for the moving coil is separated from the first part made of synthetic material by a second part having a heat resistance greater than that of the first part, it is possible to choose a good heat conducting material for the support and therefore increase heat dissipation of the moving coil.

These and other features and advantages of the invention will be brought out in the description which follows given by way of example with reference to the accompanying drawing.

DETAILED DESCRIPTION OF THE PREFERRED EMBODIMENTS

Figure 1:
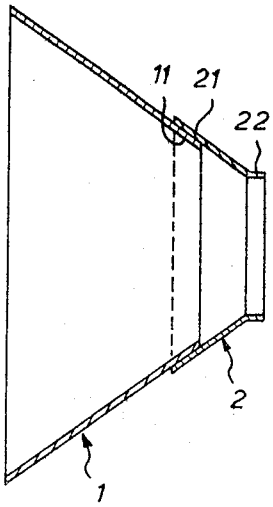
FIG. 1 is a cross-sectional view of a diaphragm for a loudspeaker according to the invention.

FIG. 1 shows a loudspeaker diaphragm of two-part construction including parts 1 and 2 each of generally frustoconical configuration. The first part 1 generally connected by a peripheral suspension member to the basket support (not shown in FIG. 1) is made of synthetic polymeric or copolymeric material, such as polypropylene, but may be of any other suitable material, for example polystyrene, and have any desired cross section.

The second part 2 attached to the support for the moving coil (not illustrated in FIG. 1) has its large diameter end or connecting zone 21 attached in a corresponding smaller diameter end or connecting zone 11 of the first part 1. The small diameter end zone of the second part 2 is extended by a connecting or fastening zone 22 to the support for the moving coil. The fastening zone 22 at the moving coil support has a generally cylindrical configuration here. In order that the moving coil support may be made of good heat conducting material to increase the heat dissipation potential of the moving coil, e.g., aluminum, the second part 2 is made of paper or a plastic such as a high temperature aromatic polyamide sold under the mark "Nomex" by Dupont de Nemours, or a high temperature polyimide sold under the trade mark "Kapton" also by Dupont de Nemours, or the like, so that it is possible to obtain good operating characteristics with a support reaching temperatures greater than 150° C. (for example 220° C.) even if the material of which the first part 1 is made is resistant to temperatures less than 150° C.

In the present case the connecting zone 11 on the first part 1 is disposed inside the connecting zone 21 of the second part 2. The connecting zones 11 and 21 which are attached to each other and overlie each other along a length selected for each loudspeaker as a function of its use so that taking account of the speed of sound propagation in the respective materials in contact, the wavelengths at which there may be reflections of the transverse waves when passing from one material to another, corresponds to frequencies outside the operative frequency range of the loudspeaker.

The second part 2 of the diaphragm comprising the fastening zone 22 for the moving coil support and also to the internal fixing member or spider (not shown in FIG. 1) and at the output lead is a height of the order of one quarter of the total height of the diaphragm cone.

The attachment of the various parts and members together may be effected by bonding or any other appropriate means.

Tests carried out with loudspeakers having a diameter of twenty centimeters show that, all other things being equal, a two-part diaphragm of polypropylene and paper associated with a moving coil on an aluminum support permits a power output about 20% greater than that of a polypropylene diaphragm associated with a coil on a paper support and 40% greater than a polypropylene diaphragm associated with a moving coil on an aluminum support. Other technical characteristics of loudspeakers such as the response curves, impedance curves and distortion showed no significant differences.

Figure 2:
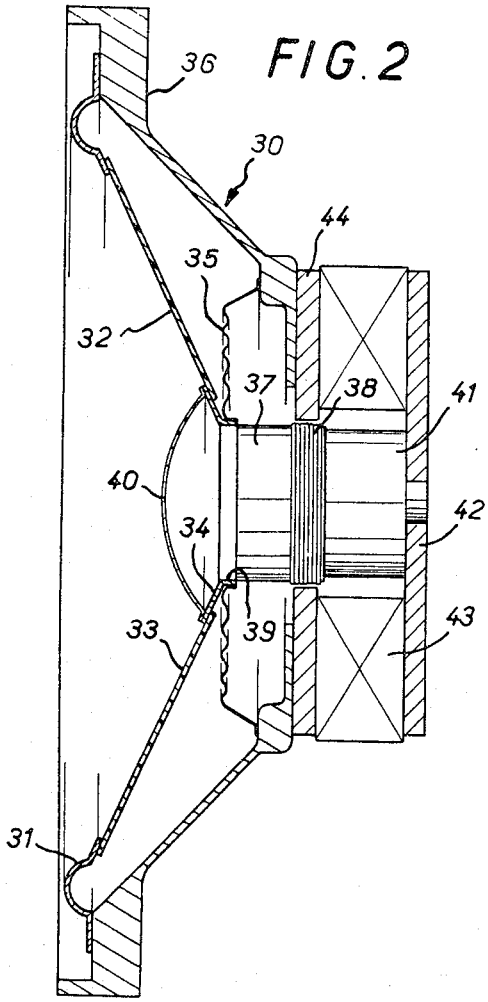
FIG. 2 is also a cross-sectional view of a loudspeaker incorporating a modified diaphragm according to the invention.

FIG. 2 shows a loudspeaker designated by general reference numeral 30 incorporating a modified diaphragm 32 according to the invention. The diaphragm 32 is also of two-part construction in this embodiment and includes a first or outer generally frustoconical part 33 connected at its larger diameter end to a peripheral suspension member 31 which in turn is attached to the outer peripheral zone of the basket support 36 of the loudspeaker. The second or inner part 34 of the two-part diaphragm 32 is attached to a generally cylindrical support 37 for a moving coil by a corresponding generally cylindrical portion 39 at the small diameter end of the second or inner diaphragm part 34. The large diameter end of the second or inner part 34 of the diaphragm 32 is bonded to the small diameter end of the first or outer diameter diaphragm part 33 along the outwardly facing surface thereof. This arrangement is in contrast to that shown in the embodiment of FIG. 1 where the connecting zone 22 of the first or outer diaphragm part 1 is attached along its inwardly facing surface. The outer and inner diaphragm parts 33 and 34, respectively, are constructed of the materials disclosed with respect to the embodiment of FIG. 1. And in accordance with the invention the inner part 34 is made of a material having a greater heat resistance that that of the synthetic material of which the outer part 33 of the diaphragm is made, whereby the inner part is adapted to withstand the heat dissapated by the moving coil support or cylindrical support 37.

The loudspeaker shown in FIG. 2 is in other respects of conventional construction and further comprises a conventional part spherical dust cap 40 attached to the large diameter end of the inner part 34 opposite the small diameter end of the outer part 33. A conventional spider 35 is likewise attached between the outer surface of the cylindrical portion 39 of the inner part 34 and the base part of the basket support 36.

The loudspeaker 30 further comprises a moving coil 38 mounted on the coil support 37. Directly behind the moving coil 38 and coaxial thereto is a pole piece 41. A ferrite ring 43 is disposed radially outwardly of the pole piece 41 and sandwiched between a front plate 44 and a rear plate 42 both of ferromagnetic material.

Of course the invention is not limited to the embodiment described and illustrated herein. Various alternatives, modifications and expedients may be resorted to without departing from the spirit and scope of the invention.

What is claimed is:

1. A loudspeaker of the type comprising a vibrating generally frustoconical composite diaphragm actuatable by a moving electrically energized heat-generating coil carried on a support, said generally frustoconical composite diaphragm comprising two parts of different materials including a first outer part of synthetic polymeric or copolymeric material of relatively low heat resistance and a second inner part extending from said first part to the support for the moving coil, said second inner part being made of a material having a heat resistance greater than that of the synthetic material of said first part whereby the coil generated heat can not adversely affect said first part.

2. The loudspeaker according to claim 1, wherein said second inner part of said diaphragm is capable of withstanding temperatures in excess of 150° C.

3. The loudspeaker according to claim 1, wherein said second inner part of said diaphragm is capable of withstanding temperatures in excess of about 220° C.

4. The outspeaker according to claim 1, wherein said second inner part is made of a fibrous material.

5. The loudspeaker according to claim 4, wherein said second inner part is made of paper.

6. The loudspeaker according to claim 1, wherein said second inner part is made of a synthetic material.

7. The loudspeaker according to claim 6, wherein said second inner part is made of a high temperature aromatic polyamide.

8. The loudspeaker according to claim 6, wherein said second inner part is made of a high temperature polyimide.

9. The loudspeaker according to claim 1, 3 or 4, wherein said support is made of a good heat conducting material.

10. The loudspeaker according to claim 9, wherein said support is made of aluminum.

11. The loudspeaker according to claim 1, wherein said first outer part is made of polystyrene.

12. The loudspeaker according to claim 1, wherein said first outer part is made of polypropylene.

13. The loudspeaker according to claim 1, wherein second inner part has a height equal to about one quarter of the total height of said diaphragm.

14. The loudspeaker according to claim 1, wherein said first and second parts of said diaphragm are bonded together along an overlapping zone.

15. A vibrating diaphragm for a loudspeaker comprising a first outer part of frustoconical configuration adapted to be attached at its large diameter end to a suspension member, and a second inner part also of frustoconical configuration adapted to be attached to a moving coil support of a loudspeaker at its small diameter end, the small diameter end of said first outer diaphragm part overlapping and bonded to the large diameter end of said second inner diaphragm part, said first outer diaphragm part being made of a synthetic polymeric or copolymeric material of relatively low heat resistance and said second inner diaphragm being made of a material having a heat resistance greater than that of the synthetic material of said first outer part and sufficient to withstand heat dissipated by the moving coil support of a loudspeaker.

* * * * *